United States Patent [19]

Devaux

[11] Patent Number: 4,662,321

[45] Date of Patent: May 5, 1987

[54] METHOD AND APPARATUS FOR REGULATING THE TEMPERATURE OF THE INSIDE SURFACE OF INTERNAL COMBUSTION ENGINE CYLINDER LINERS

[75] Inventor: Alain Devaux, St. Mande, France

[73] Assignee: Societe d'Etudes de Machines Thermiques, Saint-Denis, France

[21] Appl. No.: 775,628

[22] Filed: Sep. 13, 1985

[30] Foreign Application Priority Data

Sep. 20, 1984 [FR] France ..... 84 14452

[51] Int. Cl.[4] ..... F01P 3/02

[52] U.S. Cl. ..... 123/41.79; 123/41.84; 123/193 C

[58] Field of Search ..... 123/41.01, 41.02, 41.12, 123/41.15, 41.44, 41.83, 41.84, 41.79, 193 C

[56] References Cited

U.S. PATENT DOCUMENTS 1,968,449 7/1934 Hefti ..... 123/41.83
4,172,435 10/1979 Schumacher ..... 123/41.83

FOREIGN PATENT DOCUMENTS 59-020521 5/1984 Japan .
2019490 10/1979 United Kingdom ..... 123/41.84

*Primary Examiner*—William A. Cuchlinski, Jr.
*Attorney, Agent, or Firm*—Kenyon & Kenyon

[57] ABSTRACT

The present invention provides a method of regulating the temperature of the inside surface of cylinder liners in an internal combustion engine (e.g. a diesel engine) which is cooled by a flow of cooling fluid, the method including the improvement whereby the temperature of the cooling fluid is regulated in such a manner as to maintain the temperature of the inside surface of the cylinder liners at a reference temperature, regardless of the engine load. The invention also provides apparatus for performing the above method. The apparatus includes temperature sensors (6) situated in the thickness of the liner (1) walls between the inside surfaces thereof (1') and the cooling fluid flow ducts (10) passing through the wall.

3 Claims, 2 Drawing Figures

METHOD AND APPARATUS FOR REGULATING THE TEMPERATURE OF THE INSIDE SURFACE OF INTERNAL COMBUSTION ENGINE CYLINDER LINERS

The present invention relates to a method of regulating the temperature of the inside surface of cylinder liners in an internal combustion engine which is cooled by a flow of cooling fluid, in such a manner as to avoid corrosive wear of said surface under all conditions of engine use.

The invention also relates to apparatus for performing the method.

BACKGROUND OF THE INVENTION

Fuels derived from low grade oil, as used in sone diesel engines, have the drawback of containing a high proportion of sulfur compounds. The water generated by combustion facilitates the formation of sulfuric acid under certain conditions of temperature and pressure. This acid corrodes the walls of the cylinder liners, thereby reducing their lifetime.

Experiment has shown that such corrosive wear is low or non-existent for peripheral temperatures of 150° C. However, at 130° C., the combined effects of acid and temperature give rise to maxmium chemical attack.

Providing the engine is working at full load, or close to full load, modern diesel engines have a peripheral temperature which is greater than 150° C. in the most exposed portion of their liners. However, if the engine is used at light load (e.g. 25%), the heat flow through the liner walls is divided by three, and since the flow of cooling fluid through the engine is maintained at constant temperature by a conventional regulator device, there is a correspondingly large drop in the peripheral temperature of the lining and a consequent risk of sulfuric acid attack.

In order to combat this phenomenon, basic lubricating oils are used in order to neutralize the effects of the acid. When the piston is at top dead center, that portion of the liner which is situated below the wiper rings is lubricated by oil which is continually being refreshed; however, that portion of the liner which is situated between the explosion ring and the, or each, wiper ring benefits only from the lubrication oil burnt by the engine, i.e. from about 1/200 of the fuel consumed. This portion of the liner is thus particularly exposed when its temperature reaches a critical value, since the low oil feed rate is insufficient to neutralize the acid.

Preferred implementations of the present invention solve the above drawbacks, while nevertheless reducing regulation parameters and their processing to a minimum.

SUMMARY OF THE INVENTION

The present invention provides a method of regulating the temperature of the inside surface of cylinder liners in an internal combustion engine which is cooled by a flow of cooling fluid, the method including the improvement whereby the temperature of the cooling fluid is regulated in such a manner as to maintain the temperature of the inside surface of the cylinder liners at a reference temperature, regardless of the engine load.

Advantageously, the reference temperature is chosen in such a manner that the temperature of the inside surface of the liners lies outside the range of temperatures in which sulfuric acid corrosion takes place in the conditions under which the engine is being used.

In particular, the reference temperature is chosen in such a manner that the temperature of the inside surface of the liners is always greater than the range of temperatures at which sulfuric acid corrosion takes place.

The invention also provides apparatus for regulating the temperature of the inside surface of cylinder liners in an internal combustion engine, including a flow of cooling fluid through ducts situated in the walls of the liners, means for regulating the temperature of the cooling fluid, and one or more temperature sensors located in the cylinder liner walls and associated with regulator means via control means; the apparatus including the improvement whereby the sensitive portion of the, or each, temperature sensor is located in the thickness of a liner wall between the inside surface of the liner and said ducts.

BRIEF DESCRIPTION OF THE DRAWINGS

An embodiment of apparatus in accordance with the invention is described below, by way of example, with reference to the accompanying drawings, in which.

MORE DETAILED DESCRIPTION

Figure 1:
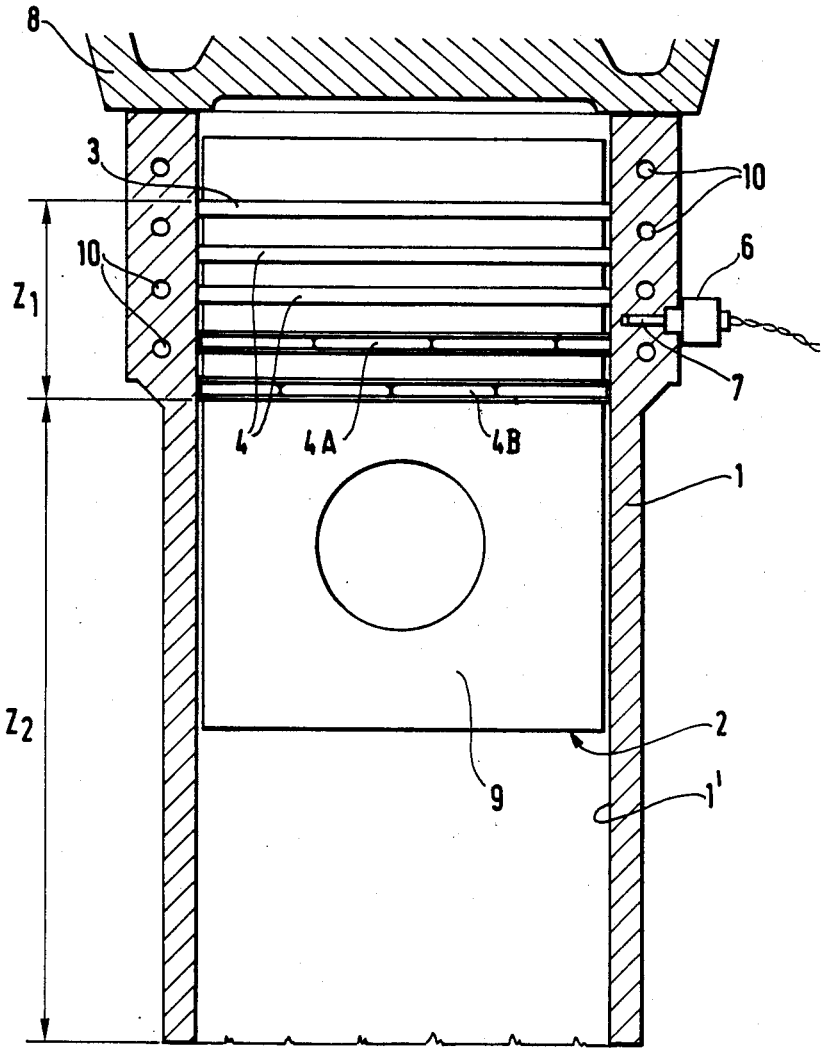
FIG. 1 is a section through a cylinder liner.

In FIG. 1, a liner 1 has an inside surface 1' surrounded by cooling fluid flow ducts 10, and is closed by a cylinder head 8 of which only a portion is shown. A piston 2 having a skirt 9 is shown at top dead center.

At the cylinder head end of the piston 2, there is an explosion ring 3, and at the skirt end thereof, there are two compression rings 4 and two wiper rings 4A and 4B. The zone $Z_1$ represents the annular portion of the surface 1' which is level with the space separating the bottom of the explosion ring from the top of the lowermost wiper ring 4B when the piston is at top dead center.

A temperature sensor 6 is located in the liner wall, with the active portion 7 of the sensor being situated at the same level as the zone $Z_1$ and in the thickness lying between the inside surface 1' and the cooling duct. The sensor 6 thus measures the temperature of the surface 1' at the level of the zone $Z_1$. Naturally, a plurality of sensors could be installed. The lubricating oil received by this zone $Z_1$ must have got past the wiper rings, and as a result, the quantity of oil received is inadequate for neutralizing sulfuric acid attack at low temperatures.

The zone $Z_2$ represents the annular portion of the surface 1' situated below the last wiper ring 4B and around the skirt.

This zone $Z_2$ receives a large quantity of basic lubricating oil.

Figure 2:
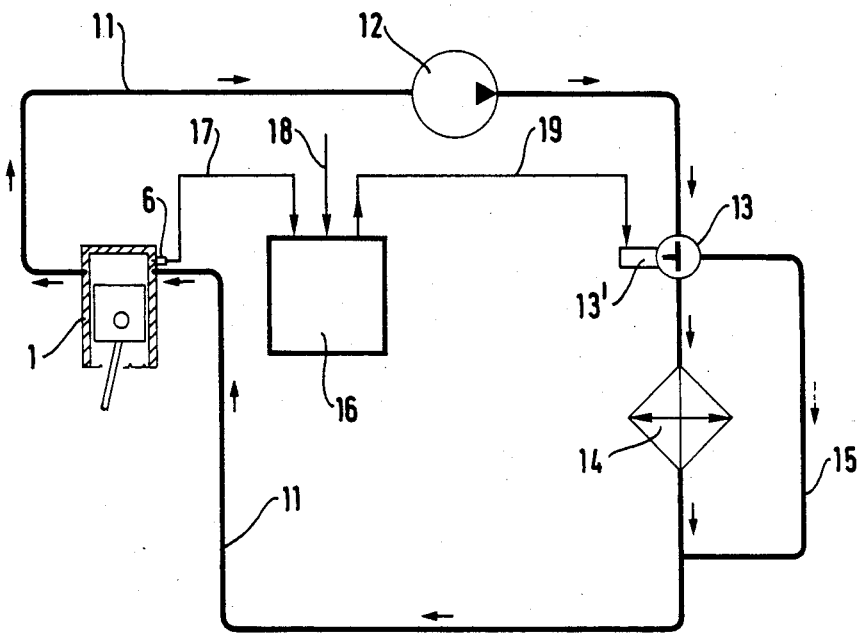
FIG. 2 is a diagram of a cooling fluid circuit.

FIG. 2 is a diagram showing the main components of regulator apparatus for performing the method. The liner 1 is cooled by circulation 11 of a cooling fluid passing through the ducts 10 shown in FIG. 1. The cooling fluid circuit includes a pump 12 and regulator means 13, 14, and 15 for regulating the temperature of the cooling fluid. These regulator means comprise a valve 13 actuated by an actuator 13', a heat exchanger 14, and a bypass duct 15. The valve 13 serves to direct a variable amount of the cooling fluid through the duct 15, thereby bypassing the heat exchanger 14. The actuator 13' actuates the valve under the control of control means 16 which are connected to the actuator 13' by an electrical, pneumatic, or hydraulic link 19. The control means 16 operate as a function of the difference between the temperature sensed by the sensor 6 and conveyed thereto over a link 17 and a reference temperature conveyed by a link 18. The reference temperature (via 18) may be adjusted as a function of engine use, and in particular as a function of the quality of the fuel being used and of its sulfur compound content.

Regulation takes place as follows:

When the engine is at full load, or close to full load; a maximum flow of heat passes through the zone $Z_1$. This zone is maintained at a temperature of 150° C., for example, by the means for regulating the temperature of the cooling fluid. The effect of the sulfuric acid is thus held down to a minimum level.

If the load on the engine falls off, the flow of heat through the zone $Z_1$ also falls off, and if the temperature of the cooling fluid circulating through the ducts 10 were to be maintained constant, the temperature of the zone $Z_1$ would fall, thereby subjecting the inside wall of the liner to attack from sulfuric acid.

In accordance with the invention, such a drop in temperature is measured by the sensor 6 thus causing the control means 16 to reduce the flow of cooling fluid through the heat exchanger 14, by suitably maneuvering the valve 13 to cause a portion of cooling fluid to flow through the bypass duct 15. As a result, the temperature of the cooling fluid increases, thereby reducing the quantity of heat which is removed from the zone $Z_1$ via the ducts 10. This thus has the effect of maintaining the temperature of the endangered zone to a sufficiently high value to ensure minimal damage from the sulfuric acid.

I claim:

1. Apparatus for regulating the temperature of the inside surface of a cylinder liner in an internal combustion engine, including ducts situated in a wall of the liner for carrying a flow of cooling fluid, means for regulating the temperature of the cooling fluid, and at least one temperature sensor located in the cylinder liner wall and associated with the regulator means for regulating the temperature of the cooling fluid in order to keep said temperature of the inside surface of the liner outside the range in which sulfuric acid corrosion takes place, wherein the improvement comprises:

the sensitive portion of the at least one temperature sensor is located in the thickness of the liner wall between the inside surface of the liner and said ducts.

2. Apparatus according to claim 1 wherein said internal combustion engine comprises a piston reciprocable within the cylinder, the piston having a plurality of piston rings including a lowermost oil wiping ring and wherein said at least one temperature sensor is located in a zone of the cylinder liner above the position of the lowermost oil wiper ring when the piston is in a top dead center position and said ducts for carrying the flow of cooling fluid are also located in said zone.

3. A method of regulating the temperature of the inside surface of cylinder liners in an internal combustion engine which is cooled by a flow of cooling fluid, the method including the improvement wherein the temperature of the cooling fluid is regulated in such a manner as to maintain the temperature of the inside surface of the cylinder liners at a reference temperature outside the range of temperatures in which sulfuric acid corrosion takes place, regardless of the engine load;

wherein the reference temperature is chosen in such a manner that the temperature of the inside surface of the liners is always greater than the range of temperatures at which sulfuric acid corrosion takes place; and wherein the step of maintaining the temperature of the inside surface of the cylinder liners comprises:

sensing the temperature in each cylinder liner at a location close to the inside surface of the liner in a location in a zone above a lowermost oil wiper ring of a piston therein when the piston is in a top dead center position in the cylinder and delivering a flow of coolant fluid into contact with the cylinder liner in said zone to maintain said sensed temperature at a predetermined value relative to said reference temperature.

* * * * *